US006698310B1

(12) United States Patent
Yeh

(10) Patent No.: US 6,698,310 B1
(45) Date of Patent: Mar. 2, 2004

(54) SLEEVE FOR A VEHICLE HANDBRAKE LEVER

(76) Inventor: Chia-Lung Yeh, No. 11, Huchu 3rd St., Changhua City (TW)

( * ) Notice: Subject to any disclaimer, the term of this patent is extended or adjusted under 35 U.S.C. 154(b) by 0 days.

(21) Appl. No.: 10/448,342

(22) Filed: May 30, 2003

(51) Int. Cl.[7] ..... G05G 1/10

(52) U.S. Cl. ..... 74/544; 74/543; 74/523; 74/557; 74/548

(58) Field of Search ..... 64/543–551, 557, 64/519, 469, 473.1, 473.15, 556, 523, 524, 525, 526; 180/287

(56) References Cited

U.S. PATENT DOCUMENTS

| | | | | | |
|---|---|---|---|---|---|
| 1,285,351 | A | * | 11/1918 | Parsons | 74/544 |
| 2,481,966 | A | * | 9/1949 | Zivi | 74/481 |
| 3,789,645 | A | * | 2/1974 | Schmid | 74/491 |
| 4,535,647 | A | * | 8/1985 | Gault | 74/543 |
| 4,750,380 | A | * | 6/1988 | Hoblingre et al. | 74/556 |
| 4,934,496 | A | * | 6/1990 | Barske et al. | 192/220.4 |
| 5,148,718 | A | * | 9/1992 | Kakuguchi et al. | 74/553 |
| 5,513,544 | A | * | 5/1996 | Winkler et al. | 74/547 |
| 5,970,814 | A | * | 10/1999 | Smith et al. | 74/473.15 |
| 6,116,370 | A | * | 2/2000 | Puigbo | 180/287 |
| 6,038,937 | A | * | 3/2000 | Van Order et al. | 74/473.1 |
| 2003/0150291 | A1 | * | 8/2003 | Grenier | 74/545 |

FOREIGN PATENT DOCUMENTS

| | | | | |
|---|---|---|---|---|
| GB | 1168338 | * | 10/1969 | 74/543 |

* cited by examiner

*Primary Examiner*—Vinh T. Luong
(74) *Attorney, Agent, or Firm*—Rabin & Berdo, P.C.

(57) ABSTRACT

A sleeve for a vehicle handbrake lever has a stationary tube (21) adapted to mount on the handbrake with a button and a movable tube (22) rotatably and slidably mounted on the stationary tube (21). The movable tube (22) has a limit block (222) protruding to the stationary tube (21). The stationary tube (21) has an L-shaped cutout (214) composed of a transversal slot (216) and a longitudinal slot (215) to movably receive the limit block (222). By locating the limit block (222) in the longitudinal slot (215) or the transversal slot (216), the movable tube (22) selectively releases or presses the button to keep the handbrake locked or unlocked.

4 Claims, 5 Drawing Sheets

SLEEVE FOR A VEHICLE HANDBRAKE LEVER

BACKGROUND OF THE INVENTION

1. Field of the Invention

The present invention relates to a sleeve for a vehicle handbrake lever, and more particularly to a sleeve for a vehicle handbrake lever which selectively restricts the handbrake lever in an unlocked position.

2. Description of Related Art

With reference to FIG. 6, a handbrake lever is a brake fitted beside a driver's seat in a vehicle such as a car, which a driver operates by hand to selectively keep the car stationary when parked. The handbrake lever is composed of a handle (40) and a button (41) secured at a front end of the handle (40) to release the handle (40). When parking the car, the handbrake lever is pulled up to arrest the car and a ratchet system keeps the handle (40) stationary in a locking position. When preparing to drive the car away, the button (41) is pressed first to release the handle (40) from the locking position and then the handle (40) is pushed down to release the car.

In recent years, special driving techniques such as stunt driving and hi-jack evasion procedures have involved frequent and violent use of the handbrake lever to suddenly stop or turn a car. Take sharp-turning for example, the handbrake lever is pulled up to lock the front wheels suddenly when the car is turning fast. At that moment, the tail of the car swings out to make the car rotate around the front wheels because of inertia force. Then, the handbrake lever is released again so that the car can move forward again at the end of the sharp turning maneuver. However, pressing the button (41) to release the handle (40) before putting down the handbrake lever wastes precious time during such a maneuver that requires split-second timing and that may aggravate the danger to which the driver is already exposed.

To overcome the shortcomings, the present invention tends to provide a sleeve for a handbrake lever to mitigate and/or obviate the aforementioned problems of the handbrake lever.

SUMMARY OF THE INVENTION

The main objective of the invention is to provide a sleeve for a handbrake lever, which selectively restricts the handbrake lever in an unlocked position.

Other objects, advantages and novel features of the invention will become more apparent from the following detailed description when taken in conjunction with the accompanying drawings.

DETAILED DESCRIPTION OF PREFERRED EMBODIMENT

Figure 1:
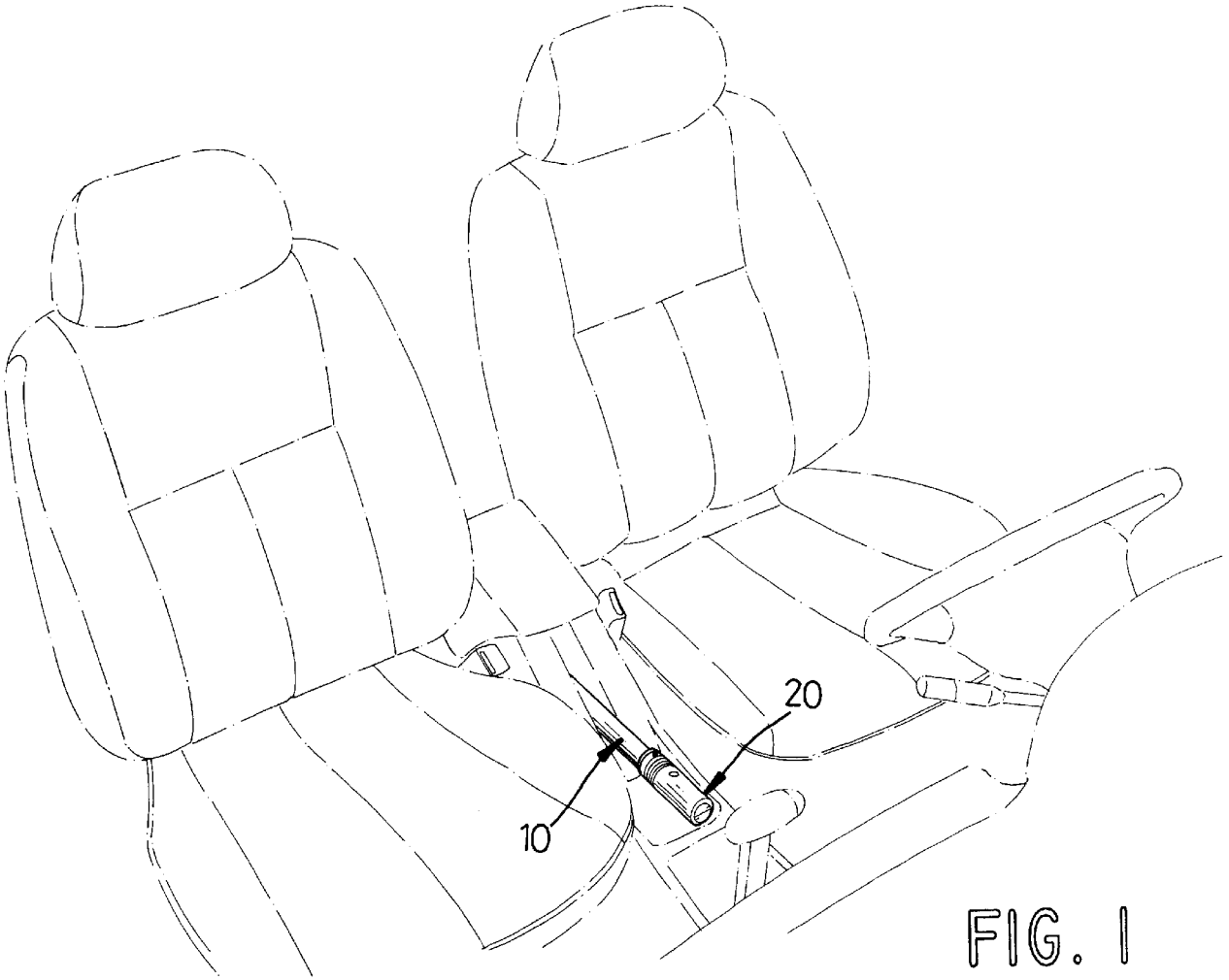
FIG. 1 is a perspective view of a sleeve for a handbrake lever in accordance with the present utility model, wherein the sleeve is adapted to mount on a handbrake lever.

With reference to FIG. 1 showing a sleeve for a handbrake lever in accordance with the present invention, the sleeve (20) is adapted to mount on a handbrake lever in a car. The handbrake lever is composed of a handle, (10) and a button (11) is attached at a front end of the handle (10).

Figure 2:
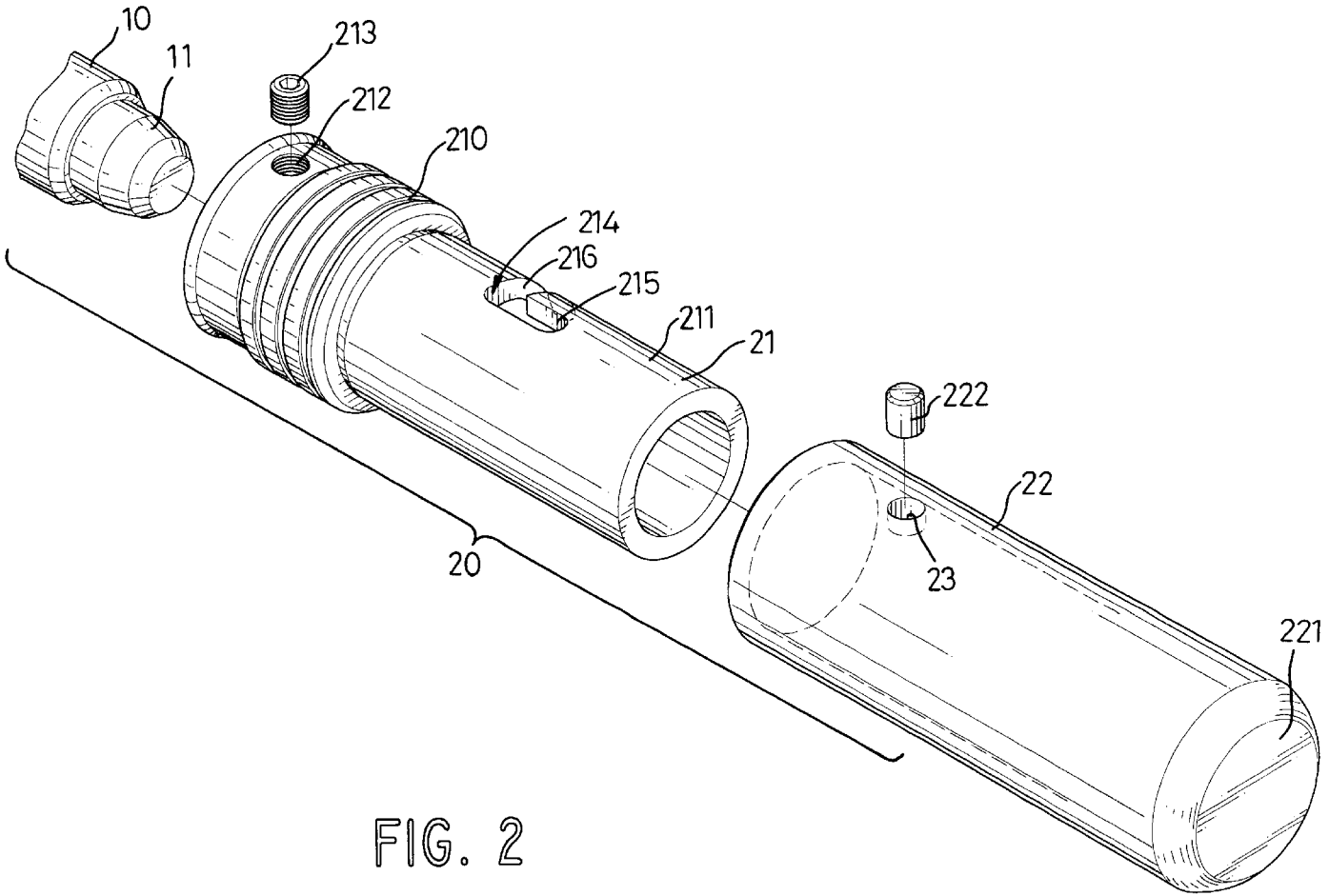
FIG. 2 is an exploded perspective view of the sleeve for a handbrake lever in FIG. 1.
Figure 3:
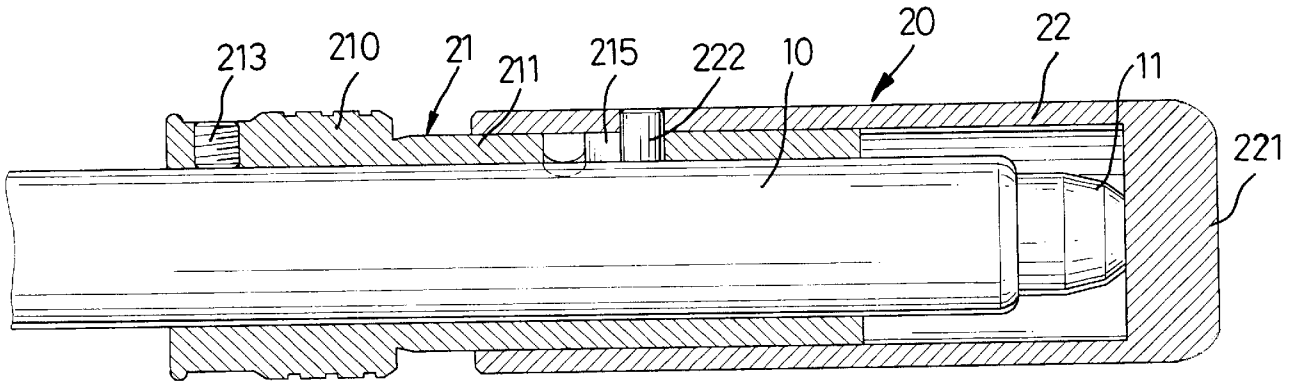
FIG. 3 is a cross-section side plane view of the sleeve in FIG. 1, wherein the handbrake lever is in a locked position.

With reference to FIGS. 2, and 3, the sleeve (20) comprises a stationary tube (21) and a movable tube (22) slidably and rotatably mounted on the stationary tube (21).

The stationary tube (21) is adapted to mount on the handle (10) and is a hollow cylinder having a fixing end (210), a connecting end (211), a threaded hole (212), and an L-shaped cutout (214). The fixing end (210) has an outer diameter larger than the outer diameter of the connecting end (211) and has the threaded hole (212) defined through the stationary tube (21). A bolt (213) engages with the threaded hole (212) to abut to the handle (10) to make the stationary tube (21) immovable on the handbrake lever. The connecting end (211) is accommodated inside the movable tube (22) and has the L-shaped cutout (214) defined in the connecting end (211). The L-shaped cutout (214) is composed of a transversal slot (216) near the fixing end (210) and away from the button (11) and a longitudinal slot (215) axially extending toward to the movable tube (22) to near the button (11).

The movable tube (22) is a hollow cylinder with an open end (not numbered), a closed end (221), a limit block (222), a block hole (23), and an inner cylindrical recess (not numbered) corresponding to the connecting end (211) of the stationary tube (21). The movable tube (22) accommodates the connecting end (211) of the stationary tube (21) via the open end and has the through hole (23) defined through the movable tube (22) and aligning with the L-shaped cutout (214) of the stationary tube (21). The limit block (222) penetrates the through hole (23) and partially inserts into the L-shaped cutout (214). When the limit block (222) is located at an extreme end of the longitudinal slot (215), the closed end (221) does not press the button (11) so that the handbrake lever is in a locked situation. The inner cylindrical recess has a length shorter than a length from the button (11) to a joint between the fixing end (210) and the connecting end (211). Thereby, the movable tube (22) is enabled to slidably move toward to the fixing end (210) to press the button (11) to unlock the handbrake lever. Therefore, when the limit block (222) locates inside the longitudinal slot (215), the movable tube (22) selectively moves forward or backward to control the handbrake lever as in a normal driving mode. Optionally, the limit block (222) can be a pin or a bolt in cooperation with the through hole (23). Optionally, the limit block (222) is integrally formed on the movable tube (22) toward to the inner cylindrical recess to movably insert into the L-shaped cutout (214) of the stationary tube (21).

Figure 4:
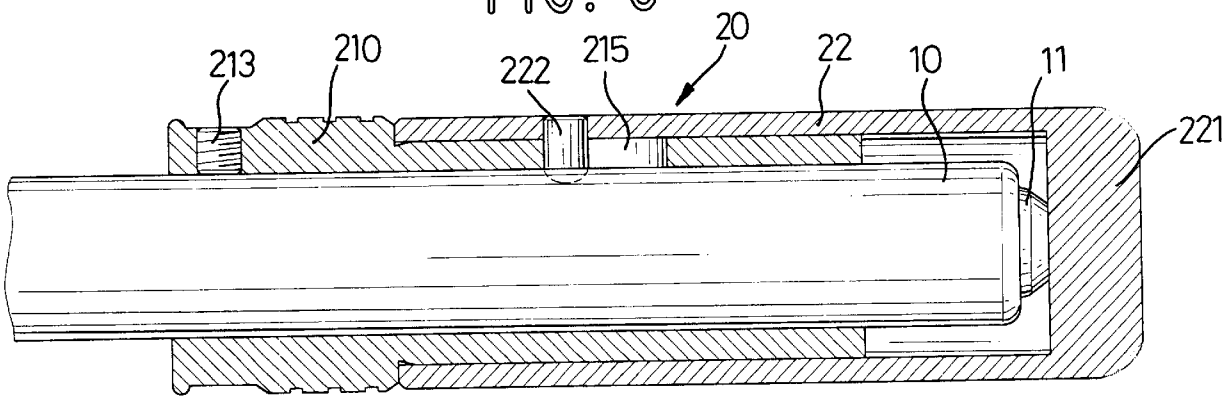
FIG. 4 is a cross-section side plane view of the sleeve in FIG. 3, wherein the handbrake lever is in an unlocked position.
Figure 5:
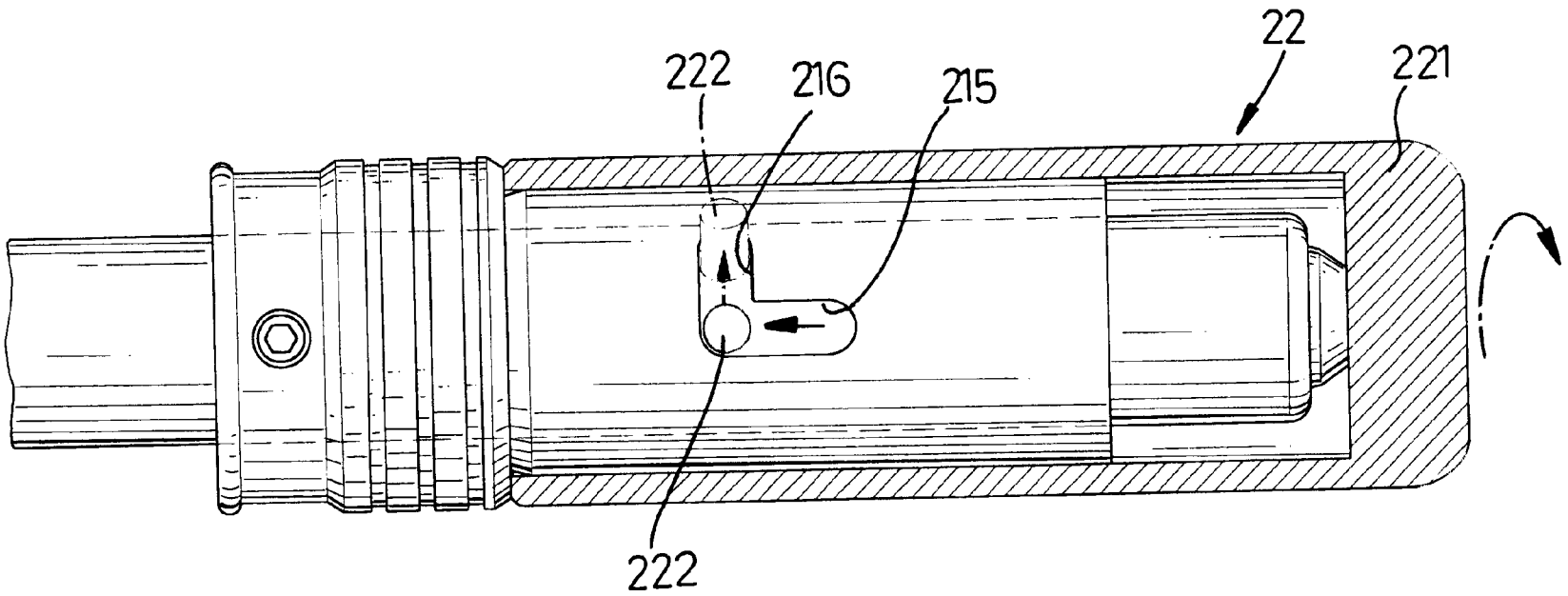
FIG. 5 is a partially cross-section operation view of the sleeve from a top side showing a movement of a limit block.
Figure 6:
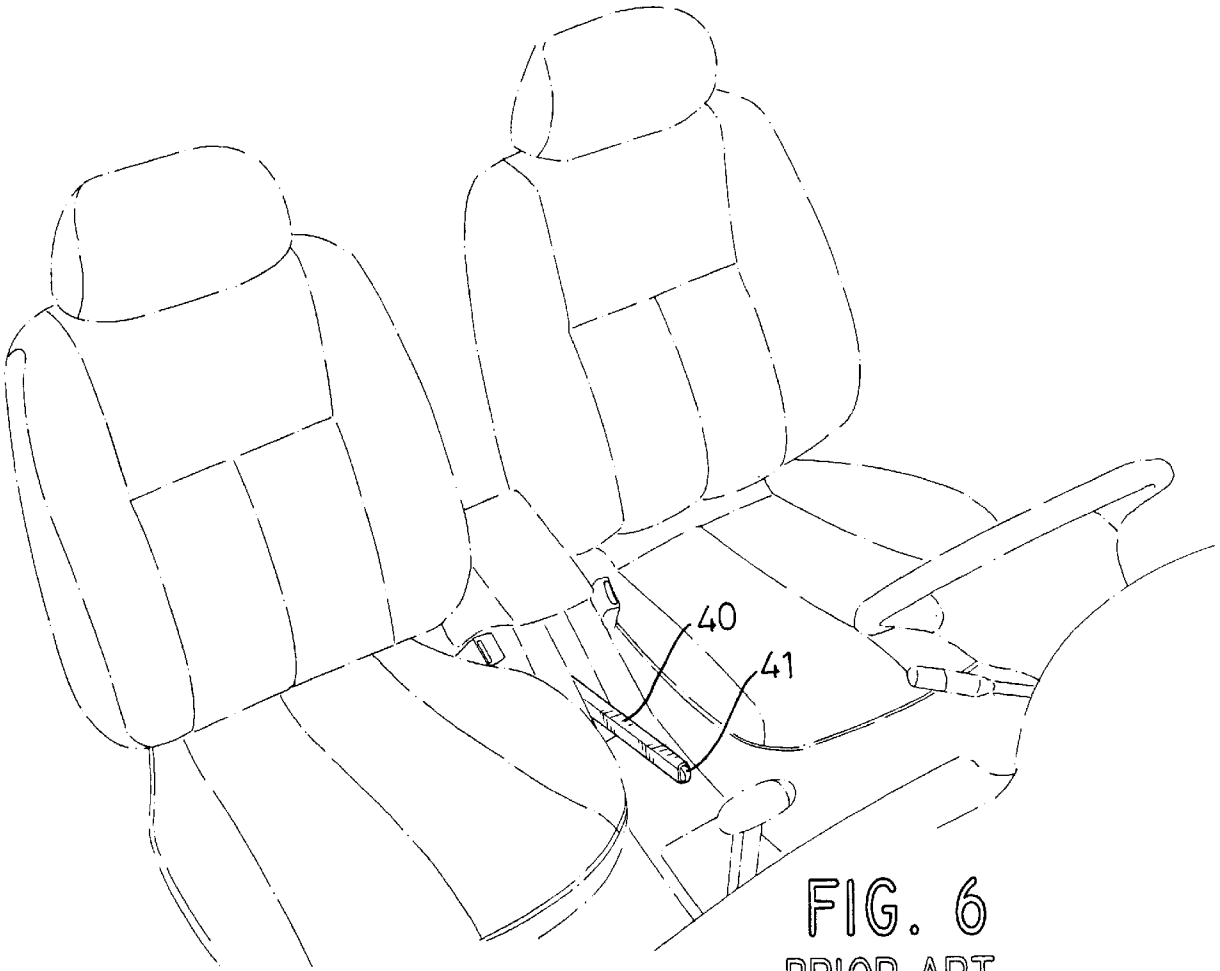
FIG. 6 PRIOR ART
FIG. 6 is a perspective view of a conventional handbrake.

With reference to FIGS. 4 and 5, the movable tube (22) is selectively pushed toward to the fixing portion (210) and axially rotates to make the limit block (222) locate inside the transversal slot (216). Thereby, the movable tube (22) is fixed and limited to keep the button (11) pressed so that the handbrake lever is kept in an unlocked situation and suitable for rapid execution of maneuvers involving the hand brake.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sleeve for a vehicle handbrake lever composed of a handle and a button attached at a front end of the handle to release the handbrake lever, the sleeve comprising:

a stationary tube (21) adapted to immovably mount on the handle and having an L-shaped cutout (214) defined in the stationary tube (21), wherein the L-shaped cutout (214) is composed of a transversal slot (216) and a longitudinal slot (215); and a movable tube (22) slidably and rotatably surrounding the stationary tube (21) to adapt to selectively press the button and having a limit block (222) secured on the movable tube (22) to movably insert into the L-shaped cutout (214) and a closed end (221) adapted to selectively abut the button of the handbrake lever;

wherein the transversal slot (216) of the L-shaped cutout (214) is far away from the closed end (221) and the longitudinal slot (215) of the L-shaped cutout (214) extends to near the closed end (221);

whereby, when the limit block (222) locates in the longitudinal slot (215), the movable tube (22) freely moves along the stationary tube (21); and when the limit block (222) locates in the transversal slot (216), the movable tube (22) is locked to adapt to keep the button pressed.

2. The sleeve for a vehicle handbrake lever as claimed in claim 1, wherein the stationary tube (21) comprises:

a fixing end (210) having a threaded hole (212) defined in the fixing end (210) and a bolt (213) penetrating the threaded hole (212) to adapt to firmly abut on the handle; and a connecting end (211) having an outer diameter smaller than an outer diameter of the fixing end (210) and having the L-shaped cutout (214) defined in the connecting end (211).

3. The sleeve for a handbrake lever as claimed in claim 1, wherein the movable tube (22) further has a through hole (23) defined in the movable tube (22) to align with the L-shaped cutout (214) in the stationary tube (21); and the limit block (222) is a pin penetrating the through hole (23) to movably insert into the L-shaped cutout (214).

4. The sleeve for a handbrake lever as claimed in claim 2, wherein the movable tube (22) further has a through hole (23) defined in the movable tube (22) to align with the L-shaped cutout (214) in the stationary tube (21); and the limit block (222) is a pin penetrating the through hole (23) to movably insert into the L-shaped cutout (214).

* * * * *